United States Patent [19]

Delesalle

[11] Patent Number: 4,641,613

[45] Date of Patent: Feb. 10, 1987

[54] PROCESS FOR THE STARTING AND LOW-LOAD RUNNING OF A DIESEL ENGINE AND A DIESEL ENGINE PUTTING THIS PROCESS INTO PRACTICE

[75] Inventor: Jacques Delesalle, Mulhouse, France

[73] Assignee: Societe Alsacienne de Constructions Mecaniques de Mulhouse, France

[21] Appl. No.: 704,173

[22] Filed: Feb. 22, 1985

[30] Foreign Application Priority Data

Mar. 2, 1984 [FR] France ..... 84 03256

[51] Int. Cl.[4] ..... F02N 17/02

[52] U.S. Cl. ..... 123/179 H; 123/64; 123/90.11

[58] Field of Search ..... 123/64, 90.11, 179 R, 123/179 H, 568, 321, 345

[56] References Cited

U.S. PATENT DOCUMENTS

| | | | |
|---|---|---|---|
| 1,794,799 | 3/1931 | Schwarz . | |
| 1,934,238 | 11/1933 | Schimanek . | |
| 1,952,881 | 3/1934 | Minter | 123/568 |
| 2,528,983 | 11/1950 | Weiss | 123/345 X |
| 3,709,201 | 1/1973 | Cook | 123/64 |
| 4,009,695 | 3/1977 | Ule . | |
| 4,096,697 | 6/1978 | Treuil | 123/179 H X |
| 4,114,643 | 9/1978 | Aoyama et al. | 123/321 X |
| 4,176,624 | 12/1979 | Bielecki et al. | 123/90.11 |

FOREIGN PATENT DOCUMENTS

| | | | |
|---|---|---|---|
| 2728259 | 1/1979 | Fed. Rep. of Germany . | |
| 2259998 | 8/1975 | France | 123/179 H |
| 2406087 | 5/1979 | France . | |

*Primary Examiner*—Tony M. Argenbright
*Attorney, Agent, or Firm*—Wegner & Bretschneider

[57] ABSTRACT

The invention relates to the diesel engine industry. To heat the air contained in the cylinder up to the fuel ignition temperature, the piston is made to execute several successive compression/expansion cycles with the inlet valve and exhaust valve closed and with fuel injection cut off. During starting and under low load, the engine operates according to a cycle of more than four strokes, for example six, eight or ten strokes. An improvement in the conditions of starting and low-load running, especially for supercharged diesel engines of reduced compression ratio.

9 Claims, 6 Drawing Figures

PROCESS FOR THE STARTING AND LOW-LOAD RUNNING OF A DIESEL ENGINE AND A DIESEL ENGINE PUTTING THIS PROCESS INTO PRACTICE

The present invention relates to a process for the starting and low-load running of diesel engines, in which fuel injection and the opening of the valves are controlled by an electronic monitoring system.

At the present time, there are many engines already equipped with injection systems having electronic monitoring, and it has also been proposed, for example in French Pat. No. 2,339,748, to control the inlet and exhaust valves not from the cams of a camshaft any longer, but by means of electropneumatic or electrohydraulic actuators which receive the orders prepared by a computer, in which the operating parameters of the engine are entered.

An electrohydraulic valve control system for a diesel engine with electronic monitoring has been described in French patent application No. 83/15,128 filed on Sept. 23, 1983 in the name of the assignee hereof.

It is now well known that these electronic monitoring systems allow automatic or controlled setting of the optimal combinations of operating parameters of an engine, whereas the operating conditions have hitherto been determined, without any possible adjustment, by the invariable profile of the cams of the engine. Among other advantages, it is thus possible to reduce the fuel consumption of the engine and the toxicity of the exhaust gases by selection of the moment and volume of fuel injection and selection of the moment and duration of the lift of the valves.

However, engines with electronic monitoring present the same problem as conventional engines with cam control as regards starting and low-load running, especially where supercharged engines, or engines of "reduced compression ratio", are concerned, and more generally in all cases where the air compressed in the cylinder as a result of the compression stroke does not reach the ignition temperature.

It is sufficient to record that, during starting and low-load running, these conditions arise; when the ambient air is very cold; when the turbo-compressor does not deliver or has only a low delivery, with the result that the air supply to the engine is not heated as a result of compression in the turbo-compressor; and when the engine, by virtue of its construction and in order to increase its power under normal load and full load, has only a reduced compression ratio (for example, 9 or 10, whereas a similar engine would have a compression ratio of 12 or 13).

To solve this problem during starting and low-load running, because the air in the cylinders does not naturally reach the ignition temperature at the end of compression it is necessary to use expedients which make it possible to increase this temperature.

Thus, it has been proposed to make the compression ratio variable, so that this compression ratio can be increased during starting, but the practical difficulties involved in achieving this have caused such a system to be abandoned.

Another expedient is to provide a restriction of the exhaust cross-section, for example at the outlet of the exhaust turbine. However, this system is inefficient and only provides inadequate heating, because the volume of air to be heated, contained between the intake manifold and the closing flap in the exhaust circuit, is very large.

In practice, the only expedient which is used is to heat the air supply (for example, up to 70° C.), before it is introduced into the cylinders. This heating can be carried out, for example, by means of auxiliary burners in the intake manifold or by means of heat exchangers supplied by an external heat source and located in the air circuit of the engine.

It therefore becomes necessary to provide additional auxiliary equipment outside the engine itself, (as well as means of starting and stopping this equipment), but these increase the price of the engines and, in fact, are used only for a small proportion of the actual running time of the engine.

The object of the present invention is to overcome these disadvantages and allow the starting and low-load running of diesel engines with electronic monitoring, especially engines of reduced compression ratio supercharged by a turbo-compressor, without the need to resort to auxiliary means of heating the air supply.

The process involves controlling the valves and injection in such a way that, in at least some of the cylinders of the engine, several successive compression strokes are executed with the valves closed and without fuel injection.

The succession of several compression/expansion cycles, the outputs of which are different, ensures the exhaust of air, since there is no throughput and the air volume is limited to that of the cylinder. Thus, the air in the cylinder can reach the ignition temperature, and the order for fuel injection is then given, thus producing the combustion/expansion drive stroke.

Thus, in a four-stroke engine, if two successive compression/expansion cycles are provided before first ignition the engine will operate according to a six-stroke cycle. If three successive compression/expansion cycles are provided before first ignition, the engine will operate according to an eight-stroke cycle, and so on and so forth.

Of course, at the moment of starting, the compression energy is supplied by the starter, but this energy is partially recovered during expansion.

After starting and during low-load running, the engine can be operated with a reduced number of strokes (for example, six instead of eight) and the opening of the exhaust valve can be limited (in terms of duration and lift), in order to recompress the gases contained in the cylinder several times in succession, so as to increase their temperature to a sufficient level.

The invention is also aimed at a diesel engine, in which the process according to the invention is put into practice during starting and low-load running. In the microprocessor (or similar processing unit) for monitoring injection and valve opening, such an engine possesses means of periodically preventing fuel injection and periodically preventing or limiting the opening of the valves, in order to obtain several successive compression/expansion cycles before an ignition.

The invention will be understood better from a reading of the following detailed description and from an examination of the attached drawings which show by way of non-limiting examples various methods of carrying out the process according to the invention.

Figure 1:
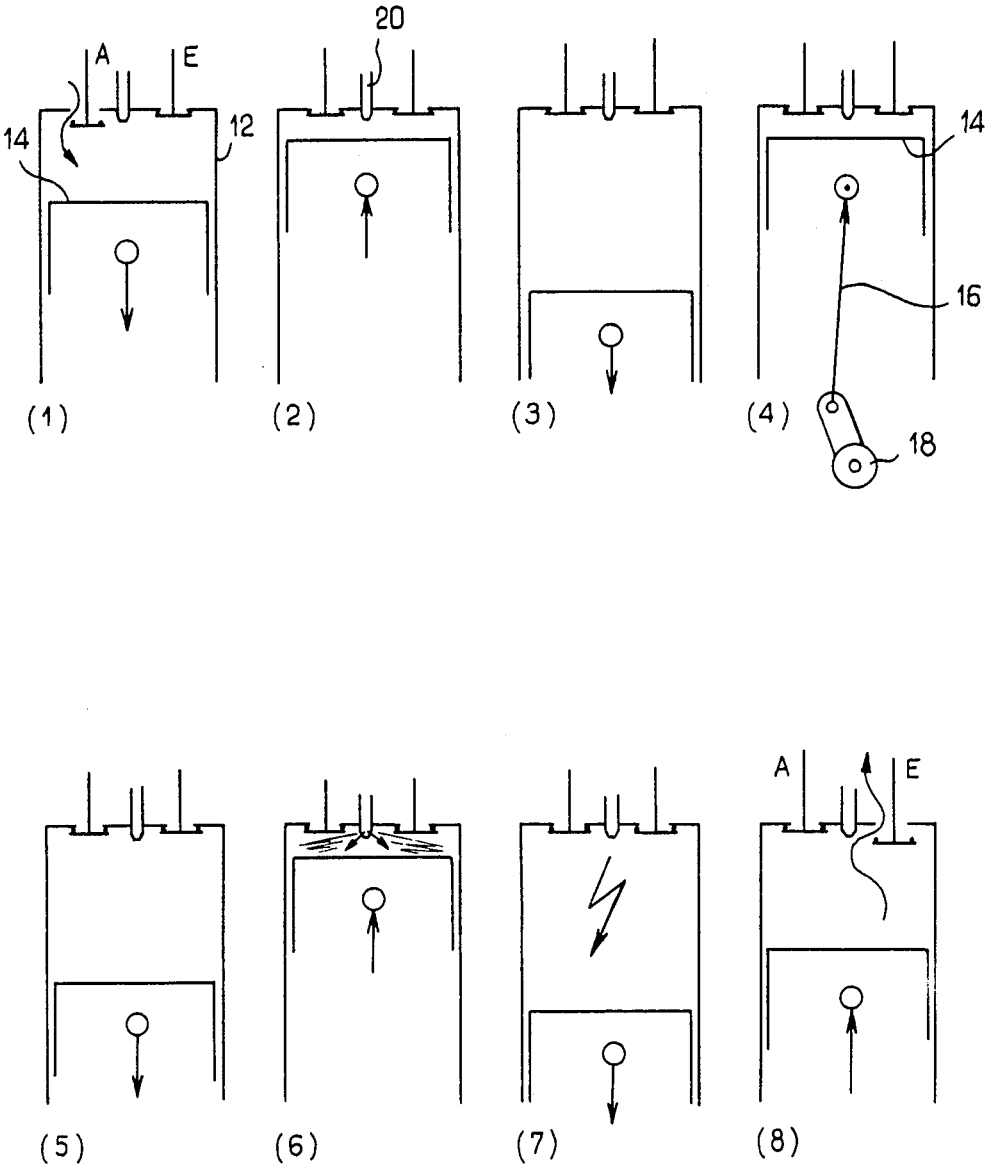
FIG. 1 is a diagramatic representation of the successive phases of the operating cycle of one of the cylinders of an engine according to the invention.

FIG. 1 shows diagramatically the cylinder 12, the piston 14, the connecting rod 16, the crankshaft 18, the inlet valve A and exhaust valve E and the fuel injector 20 of a diesel engine, preferably a supercharged diesel engine of reduced compression ratio.

The starting phase of the engine will now be described. The starter drives the shaft of the engine, and the piston 14 executes its normal intake stroke, the inlet valve A normally being open (1 in FIG. 1). The piston subsequently (2 in FIG. 1) executes its normal compression stroke, with the valves closed, and, in a conventional engine, the start of the fuel injection would be initiated at the end of this compression stroke.

However, in the absence of a system for heating the air supply (a system which the invention proposes to eliminate), the compression stroke does not enable the air to reach the temperature necessary for ignition, above all where a diesel of "reduced compression ratio" is concerned.

According to the invention, the injector 20 and the valves A and E are kept closed during at least one further expansion/compression cycle (3 and 4 in FIG. 1), and for example, as shown in FIG. 1, for a further two expansion/compression cycles (3, 4, 5 and 6 in FIG. 1).

This succession of several compression strokes (3 in the above example) ensures that the air enclosed in the cylinder is heated up to a temperature allowing the ignition of the fuel. The fuel is then injected at the end of this last compression (6 in FIG. 1), thus producing in a conventional way the combustion/expansion stroke (7 in FIG. 1), then the exhaust stroke (8 in FIG. 1), with the exhaust valve E open.

FIG. 1 therefore illustrates clearly how an engine operates according to a cycle of eight strokes instead of four strokes.

Of course, if the heating of the air is sufficient, it would also be possible to execute the first injection only after the second compression (4 in FIG. 1), and this would result in a six-stroke operating cycle.

More generally, a succession of n additional compression/expansion cycles can be executed, with injection closed and with the valves closed, thus resulting in an operating cycle of (4+2n) strokes.

The value of n is limited by the number of cylinders of the engine, and it can vary with various parameters of the engine (power, speed, temperature, etc.).

After the exhaust stroke (8 in FIG. 1), the cycle starts again at the intake stroke (1 in FIG. 1).

It can therefore be said that the problem of starting an engine is solved, according to the invention, because the valves are prevented from opening and fuel injection is prevented during the first revolutions of the engine.

Once first ignition has been effected, it is also necessary for the engine to maintain its rotation without the aid of the starter. The temperature of the end of compression, after first ignition, is already higher than that at the moment of starting, because of the contacts with the walls which are heated a little and because of the higher rotational speed ensuring more effective compression (a reduction in the relative value of the piston/cylinder leaks). However, where an engine of "reduced compression ratio" is concerned or when the intake air is too cold, some cylinders of the engine may possibly be extinguished or burn poorly, thus producing exhaust fumes considered to be toxic, if the normal four-stroke operating cycle is resumed as soon as first ignition has been effected.

Consequently, after starting and during idling or low-load running when the engine is cold, an operating cycle similar to that illustrated in FIG. 1 is maintained, if necessary with a reduction in the number n of additional compression/expansion cycles in relation to the number selected for actual starting. Thus, starting can be carried out in a ten-stroke operating cycle, and then it is possible to change progressively, as a function of one of the engine parameters, to cycles of eight and six strokes, to arrive at a normal four-stroke operating cycle when the engine is hot and when the turbo-compressor produces a normal throughput.

The exhaust stroke is shown (8 in FIG. 1) with the exhaust valve E fully open substantially over this entire stroke.

However, in the process according to the invention, it may be advantageous to restrain the exhaust of the gases, in order to retain some of the hot gases in the cylinder and thus increase the temperature reached at the end of the subsequent compressions, after first ignition, during no-load and low-load running.

Figure 2:
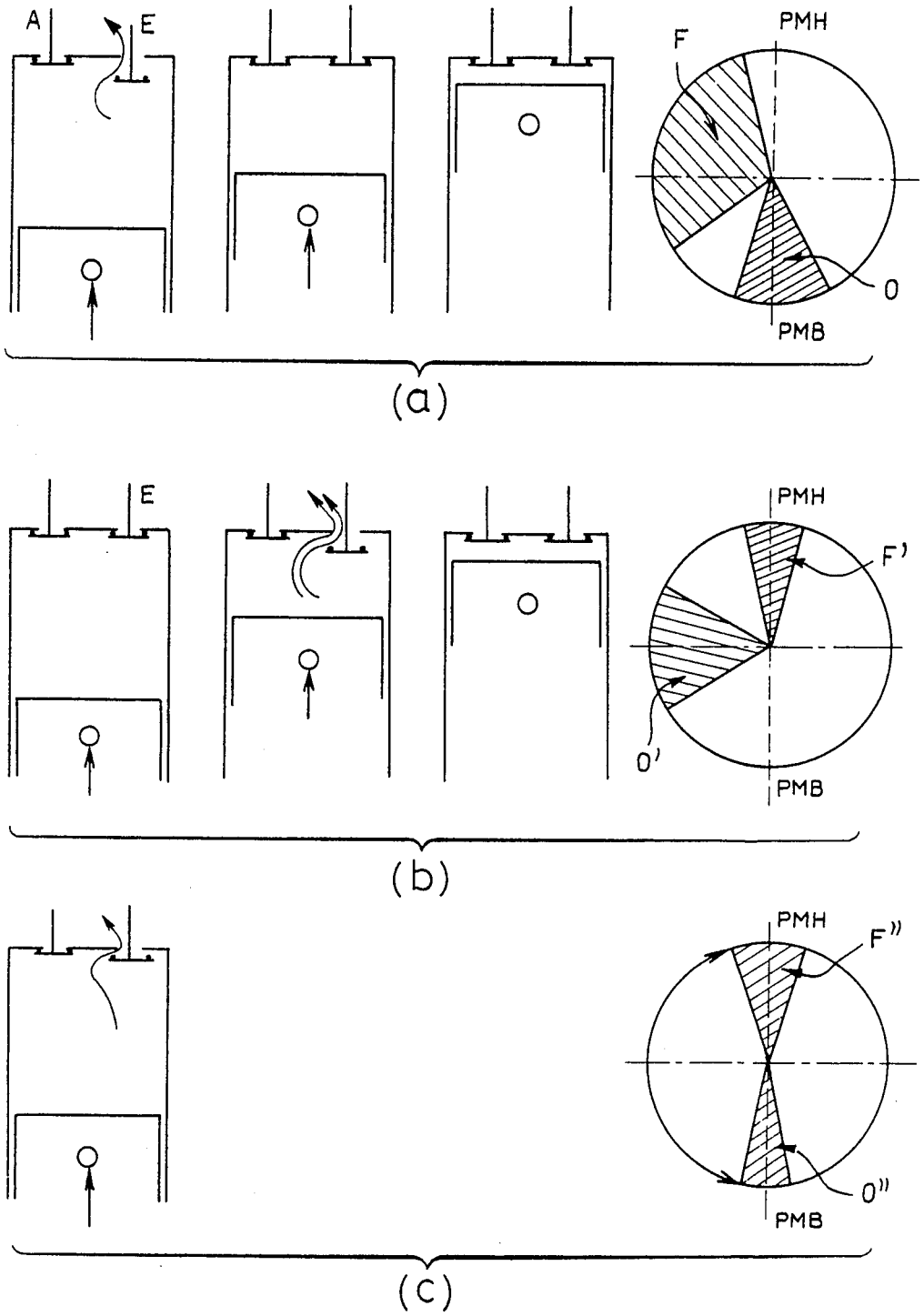
FIGS. 2(*a–c*) show in detail various methods of executing the exhaust phase.

FIG. 2 illustrates various means of obtaining such a result. In FIG. 2*a*, the exhaust valve E, open in the vicinity of BDC (in the opening zone O), closes again before UDC (closing zone F).

In FIG. 2*b*, the exhaust valve E is closed in the vicinity of BDC and only opens belatedly, for example in the vicinity of the half-stroke of the piston (opening zone O′), closing again in proximity of UDC (closing zone F′). By means of the microprocessor (or similar processing unit) which prepares the valve opening signals, it is easy to select the angular positions of the crankshaft, in which the opening or closing orders are given.

In FIGS. 2*a* and 2*b*, the total lift of the exhaust valves is utilized, but the duration of the exhaust period is reduced.

Some electronic control systems for valve opening make it possible to control not only the moment of opening, but also the amount of lift of the valve. This is shown in FIG. 2*c*, where the exhaust valve opens in a conventional way in the vicinity of BDC (opening zone O″), closing again in the vicinity of UDC (closing zone F″), but with only a partial lift which produces layering of the gases and makes some of the hot gases remain in the cylinder.

Of course, the three solutions a, b and c described above can be combined.

Diagram 1 of FIG. 1 shows the intake stroke in the starting phase of the engine, with the inlet valve A open and the exhaust valve E closed. However, it may be advantageous to execute the intake stroke with readmission of the exhaust gases. This makes it possible, immediately after the first ignition or ignitions and during no-load or low-load running, to increase the initial temperature of the gases introduced into the cylinder, before the successive compressions which enable the ignition temperature to be reached.

Figure 3:
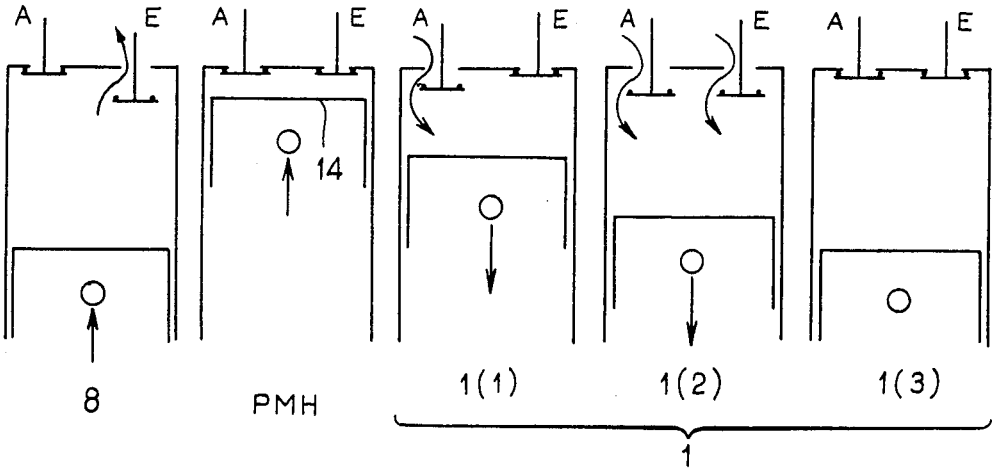
FIG. 3 shows an alternative form of the inlet phase.
Figure 4:
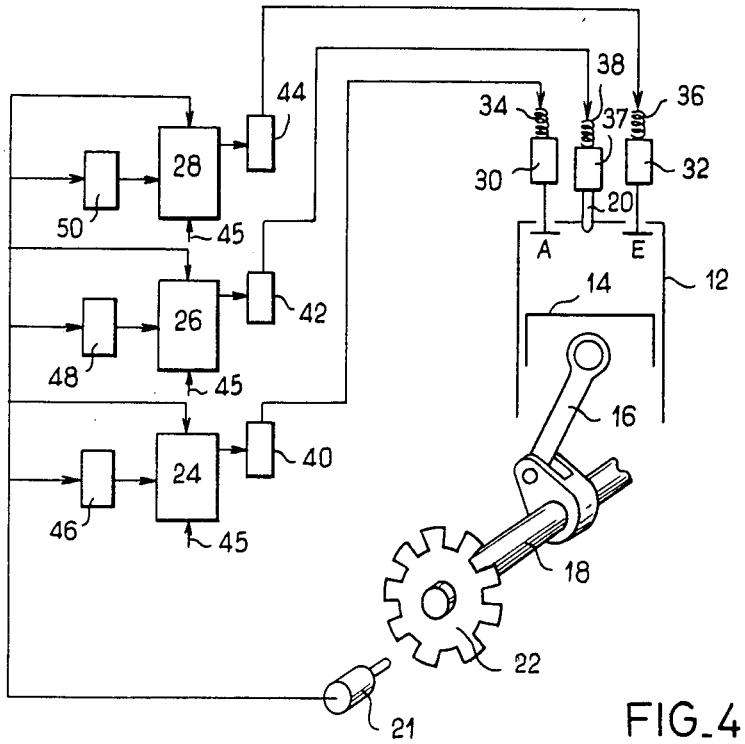
FIG. 4 is a diagramatic representation of a diesel engine according to the invention.

This is shown in FIG. 3, in which the first diagram (8) corresponds to the exhaust stroke (8) of FIG. 1. The second diagram shows the piston 14 which has arrived at UDC, and the two valves closed. The three diagrams 1(1), 1(2) and 1(3) are a breakdown of the intake stroke illustrated at (1) in FIG. 1 and show that, during a part 1(2) of this stroke, the exhaust valve is temporarily opened again to readmit a part of the hot exhaust gases which mix with the cold air introduced via the inlet valve, to heat it. Of course, here again, the lift of the exhaust valve can be complete or partial.

The process of starting and low-load running according to the invention is preferably used in all the cylinders of an engine, but it can be used in only some of them.

It is well known that heat engines in general foul up when they operate under low-load or low-running conditions. The rising oil conveyed by the pistons penetrates into the inlet and exhaust pipes, oxidizes and at length becomes coked. This fouling reduces the cross-sections and compromises smooth running.

In contrast to this, under load, the high combustion or exhaust temperature causes the combustion of oil which may rise.

The process according to the invention makes it possible to eliminate this fouling under low load, because the successions of compressions (with injection closed and the valves closed) artificially raise the temperatures of the cycle up to an exhaust temperature sufficient to burn the oil and prevent fouling, this increase in temperature being further improved as a result of the delayed or partial opening of the exhaust valves which was described with reference to FIGS. 2 and 3.

A diesel engine, for example of reduced compression ratio and supercharged by a turbo-compressor, which puts the process according to the invention into practice, will now be described. The electronic control system which does not form part of the invention will be described only in its essential parts.

This system comprises in a known way a sensor 21–22 for sensing the angular position and speed of the shaft 18 of the engine.

This sensor transmits its signals to three processing units 24, 26 and 28. The unit 24 controls the opening and closing function of the inlet valves A. The unit 28 controls the opening and closing function of the exhaust valves E. The unit 26 controls the opening and closing function of the injector 20.

The valves A and E are controlled by electrohydraulic actuators (for example, of the type described in the above-mentioned French patent application No. 83+/15,128) or electropneumatic actuators controlled by electromagnets 34 and 36. The injector 20 is controlled by an actuator 37 controlled by an electromagnet 38. The control signals prepared and processed by the units 24, 26 and 28 are transmitted to the electromagnets 34, 38 and 36 respectively by means of power interfaces 40, 42 and 44. As is known, the units 24, 26 and 28 receive other information 45 relative to other engine operating parameters and necessary for the regulating function. The units 24, 26 and 28 are set up and programmed to supply their control signals according to the conventional sequence of the four-stroke cycle.

According to the invention, the electronic control system has added to it an electronic cycle-modifying system. This system can consist of three signal-inhibiting circuits 46, 48 and 50 connected to the processing units 24, 26 and 28 and periodically cancelling the valve-opening control signals and the injection control signals which are normally prepared by the processing units on the basis of a signal given by the sensor 21–22. If the inhibitor circuit is set for a single cancellation of the signals per cycle, the engine will operate on a six-stroke basis (two successive compressions), if it is set for two cancellations per cycle, the engine will operate on an eight-stroke basis (three successive compressions, as in FIG. 1), and so on and so forth. A suitable setting means in the inhibitor circuit will make it possible to select the engine operating cycle which is appropriate for the periods of starting, no-load running and low-load running.

The particular types of opening of the exhaust valve (delayed opening, partial opening or opening with choking), described with reference to FIGS. 2 and 3, can be prepared in the processing unit 28 on the basis of information likewise supplied by the inhibitor circuit 50 or supplied directly by the regulating circuit 45.

Of course, in the event that a central processing unit replaces the three individual units 24, 26 and 28 which have been illustrated, a central cycle-modifying circuit could replace the three individual circuits 46, 48 and 50.

It appears clearly from the foregoing that, as a result of the succession of several compression/expansion strokes, the invention makes it possible to produce an internal-combustion engine with internal heating of the air supply.

In the foregoing, the description of the invention relates above all to a supercharged four-stroke diesel engine of reduced compression ratio, but the invention could apply equally to two-stroke engines, provided that the circulation of the gases is controlled at least by exhaust valves with electronically controlled opening.

I claim:

1. A process for the starting and low-load running of a diesel engine with electronic monitoring of the control of the injectors and of the valves thereof, the said process comprising adjusting the said controls to keep both the inlet and exhaust valves closed and to cut off fuel injection, in at least some of the cylinders of the engine, during several successive compression/expansion cycles, by means of which the air contained in the cylinder as a result of the preceding intake stroke of the piston is heated as a result of several successive compressions, until the ignition temperature is reached at the first fuel injection.

2. A process as claimed in claim 1, which, for the starting of the engine, comprises adjusting the control of the valves and the control of the injectors to prevent the opening of the valves and fuel injection during the first starting revolutions of the engine.

3. A process as claimed in claim 1, for the starting and low-load running of a four-stroke diesel engine, wherein the inlet and exhaust valves and injectors are kept closed during n additional compression/expansion cycles before first ignition, by means of which the engine operates according to a cycle of (4+2n) strokes during starting and low-load running.

4. A process as claimed in claim 3, wherein the control of the inlet and exhaust valves and of the injectors is adjusted in order to operate the engine according to one of the cycles of six, eight, ten or twelve strokes.

5. A process as claimed in claim 3, wherein, after the starting of the engine, the control of the valves and of the injectors is adjusted to reduce the number n of additional compression/expansion cycles.

6. A process as claimed in claim 1, wherein the control of the exhaust valves is adjusted so as to cause only a limited opening of the said valves during the exhaust stroke.

7. A process as claimed in claim 6, wherein the control of the exhaust valves is adjusted in order to cause a limited opening of the said valves during the intake stroke.

8. A diesel engine, comprising:

(a) at least one sensor for sensing the angular position and speed of the crank shaft of the engine;

(b) actuators for the inlet and exhaust valves and for the injectors;

(c) at least one processing unit receiving signals from the sensor and controlling the actuators responsive thereto; and (d) at least one cycle-modifying circuit associated with the processing unit and designed to eliminate the opening signals of the inlet and exhaust valves and of the injectors in at least some of the cylinders of the engine during several successive compression/expansion cycles of the pistons of the engine in the cylinders thereof;

(e) wherein the cycle-modifying circuit can be adjusted in order to operate the engine, during starting and under low load, according to operating cycles of between six and twelve strokes.

9. A diesel engine as claimed in claim 8, which is supercharged and the compression ratio of which is reduced.

* * * * *